US007575036B2

(12) United States Patent
Cheng

(10) Patent No.: US 7,575,036 B2
(45) Date of Patent: Aug. 18, 2009

(54) PULLING CORD WINDER FOR VENETIAN BLIND

(76) Inventor: Li-Ming Cheng, No.215, Jiouru 1st Rd., Sanmin District, Kaohsiung City (TW)

( * ) Notice: Subject to any disclaimer, the term of this patent is extended or adjusted under 35 U.S.C. 154(b) by 373 days.

(21) Appl. No.: 11/049,729

(22) Filed: Feb. 4, 2005

(65) Prior Publication Data

US 2006/0175022 A1 Aug. 10, 2006

(51) Int. Cl.
*E06B 9/30* (2006.01)

(52) U.S. Cl. ..... 160/170; 160/84.04

(58) Field of Classification Search ..... 160/170, 160/171, 178.1 R, 168.1 R, 173 R, 178.2; 242/372, 378.4, 381, 381.3, 381.6, 385.3, 242/385.4

See application file for complete search history.

(56) References Cited

U.S. PATENT DOCUMENTS 6,024,154 A 2/2000 Wang et al.
6,575,223 B1 6/2003 Chung et al.
7,311,134 B2 * 12/2007 Cheng ..... 160/173 R
7,320,354 B2 * 1/2008 Cheng ..... 160/170
2005/0205219 A1 * 9/2005 Hsu ..... 160/170

* cited by examiner

*Primary Examiner*—Blair M. Johnson
(74) *Attorney, Agent, or Firm*—Muncy, Geissler, Olds & Lowe, PLLC

(57) ABSTRACT

A pulling cord winder for a Venetian blind is installed at the bottom of a lower rail of the Venetian blind, and the pulling cord winder that winds or retrieves each pulling cord disposed separately on both sides of the Venetian blind has two corresponding engaged upper and lower bases, two spring coil wheels, a spring, a brake member, and a push rod, such that when the push rod retreats and presses the brake member, a resilience of a drawspring pushes the rough surfaces of an arc-shaped pressing board on both sides of the brake member and the two spring coil wheels into a compressed form or an open form as to brake and rotate the two spring coil wheels and control the two springs to lift or lower the Venetian blind to a fixed position.

14 Claims, 10 Drawing Sheets

PULLING CORD WINDER FOR VENETIAN BLIND

BACKGROUND OF THE INVENTION

The present invention relates to a pulling cord winder for a Venetian blind, and more particularly to a pulling cord winder including a push rod with a pulling spring and a brake member to provide a compressed state and a released state to facilitate positioning the Venetian blind by pressing rough surfaces separately disposed on both sides of an arc compressing board of the brake member and using the resilience of two compressed resilient springs disposed in a winding reel accommodating space for lifting or lowering the Venetian blind.

1. Field of the Invention

In general, a Venetian blind or shade usually comes with a pulling cord or string for lifting or lowering. Since the external pulling cord is usually exposed, children may play with the pulling cord for fun, and the pulling cord may hang a child's neck or even strangle the child and cause a fatal accident. Therefore, the safety issue is taken into consideration and the pulling cords are collected under a lower rail of the Venetian blinds or shades to prevent potential risks and accidents caused by the exposed pulling cord.

2. Brief Discussion of the Related Art

U.S. Pat. No. 6,024,154 discloses a Venetian blind lifting mechanism A with concealed pulling cords as depicted in FIG. 1.

The Venetian blind lifting mechanism A is installed in the interior of a lower rail B1 and a S-shape winding member C is installed separately on both sides of a cord retrieving/winding member A1 and disposed at two corresponding coiling rods C1, C2. The coiling rod C1 at the inner side of the S-shape winding member C is pivotally coupled with a gear A11 without being engaged with the serrate rack A10, because the gear A11 has a tooth-to-tooth correspondence with the rack A10. Therefore, the gear A11 can be pulled and moved by a pulling cord C3, when the Venetian blind B is lifted or lowered. A tooth tip A110 of the gear A11 is pressed by any tooth tip A100 of the serrated rack A10 at a certain point, and such tooth tip A110 will be worn out easily (as shown in FIG. 2), and thus making it difficult to position the pulling cord C3. However, the Venetian blind lifting mechanism A of this sort usually comes with a set of complicated components and a large housing because the Venetian blind lifting mechanism A has a S-shape winding member installed separately on both sides. The size of the lower rail B1 is also increased, and thus occupying more spaces and increasing the overall cost of the assembly. Increasing the weight of the lower rail B1 exerts a larger force on a spring installed in the Venetian blind lifting mechanism A, and thus shortening the life of its use.

U.S. Pat. No. 6,575,223 B1 has disclosed another concealed type lifting control mechanism for a Venetian blind as depicted in FIG. 3. In FIG. 3, a conventional Venetian blind D has a pulling cord winder E installed at a lower rail D1, and a brake clamping board E1 of the pulling cord winder E includes a cam E2 having a latch groove E20 at a circular wheel surface and being disposed on both sides, and a pressing board E3 installed in the middle and having a latch member E4 protruded from the pressing board E3. Seemingly, the cam E2 can be latched with a latch member E4 disposed in the middle and separately protruded from the middle as shown in FIG. 4A, yet the latch member E4 is latched with the latch groove E20 of the cam E2, when a Venetian blind D is pulled or wound. The latch member E4 will slide easily due to an external force or a collision, so that the latch member E4 cannot be latched into the latch groove E20 of the cam E2, and thus the Venetian blind D cannot be pulled or wound to achieve the positioning effect (as shown in FIG. 4B.)

SUMMARY OF THE INVENTION

The primary objective of the present invention is to overcome the foregoing shortcomings of the prior art that the lift cord control mechanism cannot achieve the positioning effect for lifting or lowering the Venetian blind, as well as its occupying too much space and incurring too much cost. Therefore, the inventor of the present invention developed a thinner pulling cord winder to reduce the weight and the force exerted on an internal spring of the pulling cord winder, and thus the overall pulling cord winder is lighter and can be installed at the bottom of a lower rail of the Venetian blind much easier.

The pulling cord winder in accordance with the present invention comprises an upper base and a lower base being engaged with each other; two spring coil wheels, each mounted on a fixed cam in a chamber at the center of the lower base; a spring disposed in each of the spring coil wheels and hooked by both end sections therein; a brake member clamped between the two spring coil wheels and hooked by a drawspring; and a push rod passing through the drawspring and contacting the brake member. With the installation of a push rod having a drawspring and the drive of a brake member, a user can wind and release the two spring coil wheels to move the spring coil wheels forward and backward or press them for positioning the Venetian blind. The two springs are wound and released accordingly to lift or lower the Venetian blind to a certain position. As a result, the two spring coil wheels are disposed at the utmost bottom of the Venetian blind, which further compress the rough surfaces on both sides of the brake member.

Another objective of the present invention is to provide a pulling cord winder that includes a fixed cam having a latch groove disposed at a lower base and a blocking member having a latch groove disposed on the internal edge of the spring coil wheel, wherein both fastening ends of the spring are latched and fixed inside the spring coil wheel.

Another objective of the present invention is to provide a pulling cord winder for a Venetian blind that uses a rough surface of an arc pressing board disposed separately on both sides of the brake member to increase the friction for compressing the spring coil wheels.

A further objective of the present invention is to provide a pulling cord winder for a Venetian blind that uses a resilience of the compressed spring in the containing space of the spring coil wheel to lift or lower a Venetian blind.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
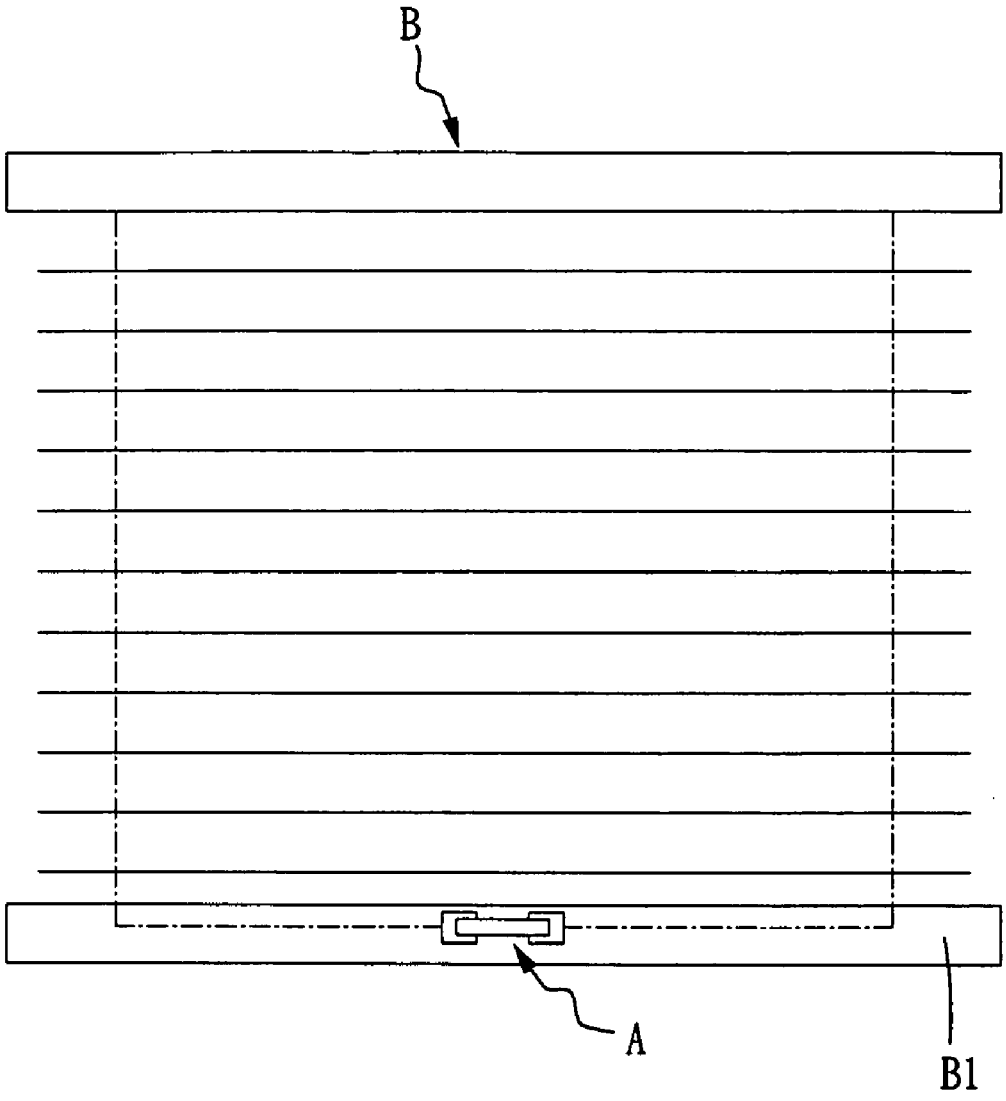
Fig. 1 PRIOR ART
FIG. 1 is a front view of a Venetian blind lifting mechanism as disclosed in U.S. Pat. No. 6,024,154.
Figure 2:
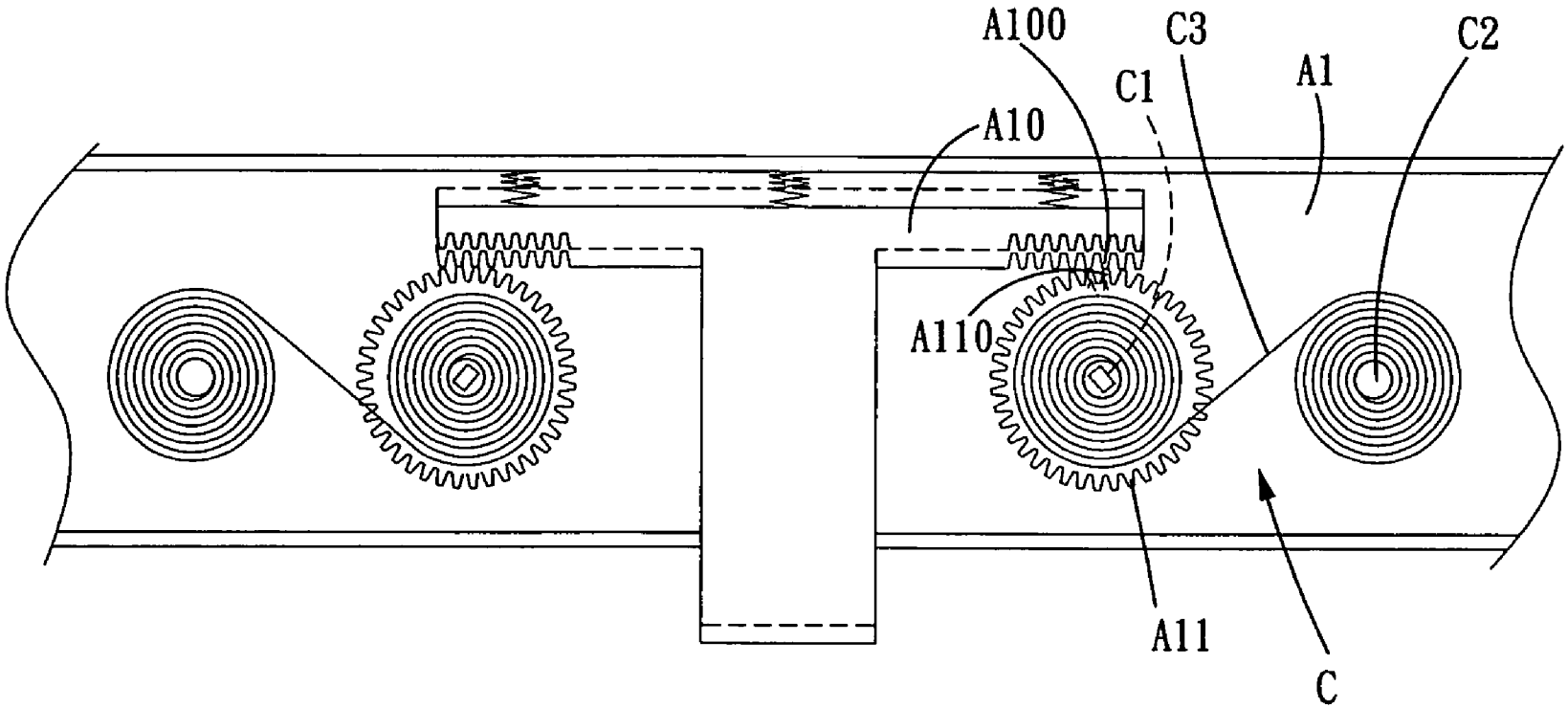
Fig. 2 PRIOR ART
FIG. 2 is a schematic view of a relation between a serrated rack and a tooth-to-tooth gear as depicted in FIG. 1.
Figure 3:
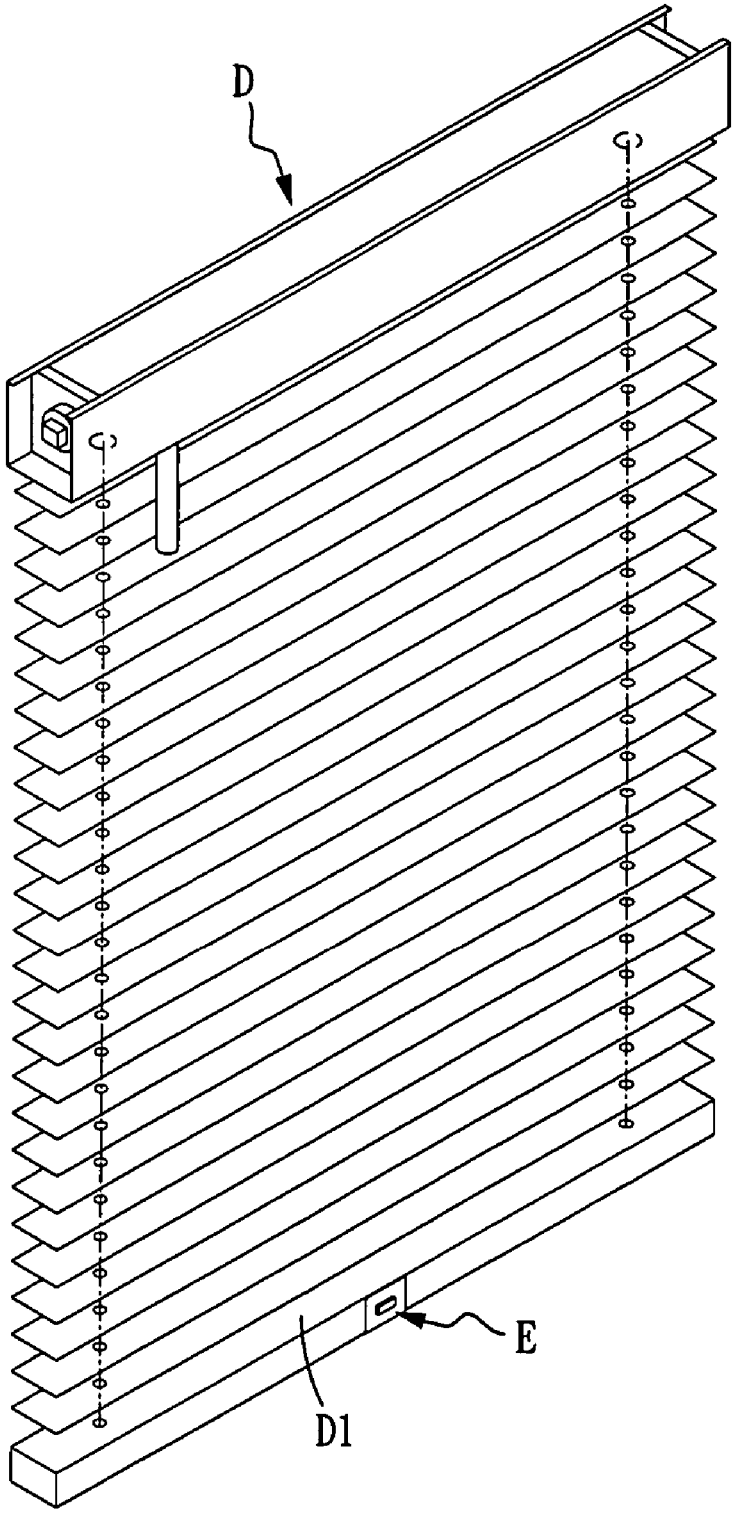
Fig. 3 PRIOR ART
FIG. 3 is a perspective view of a lifting control mechanism for a Venetian blind as disclosed in U.S. Pat. No. 6,575,223 B1.
Figure 4A:
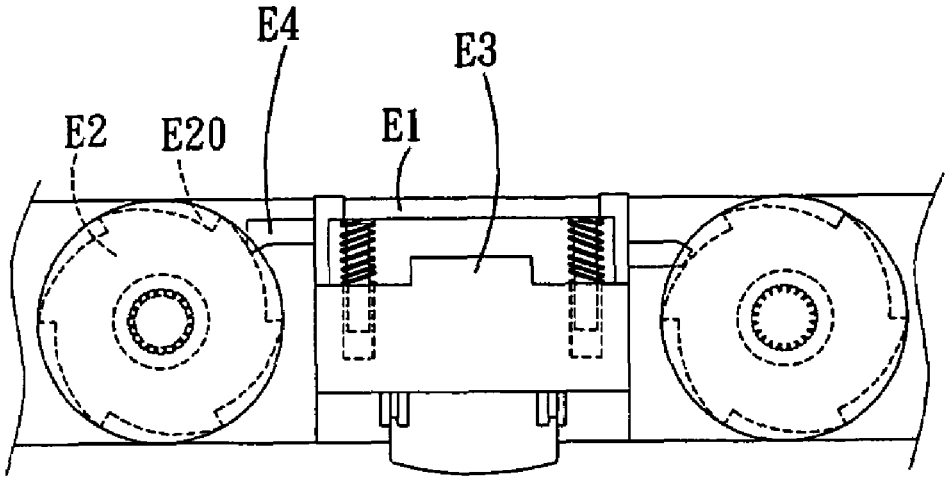
Fig. 4A PRIOR ART
FIG. 4A is a schematic view of a latch groove corresponding to a fixed cam being latched with a latch member as depicted in FIG. 3.
Figure 4B:
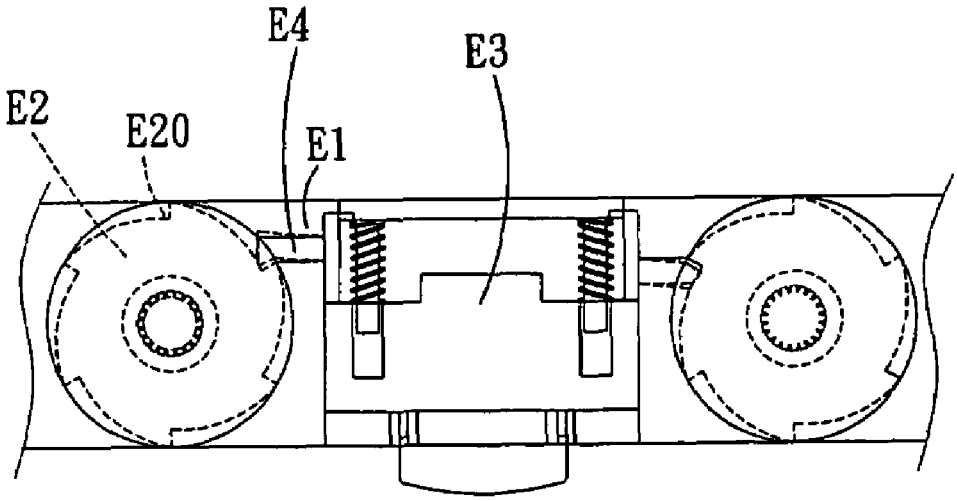
Fig. 4B PRIOR ART
FIG. 4B is a schematic view of a latch groove corresponding to a fixed cam being not latched with a latch member as depicted in FIG. 3.
Figure 5:
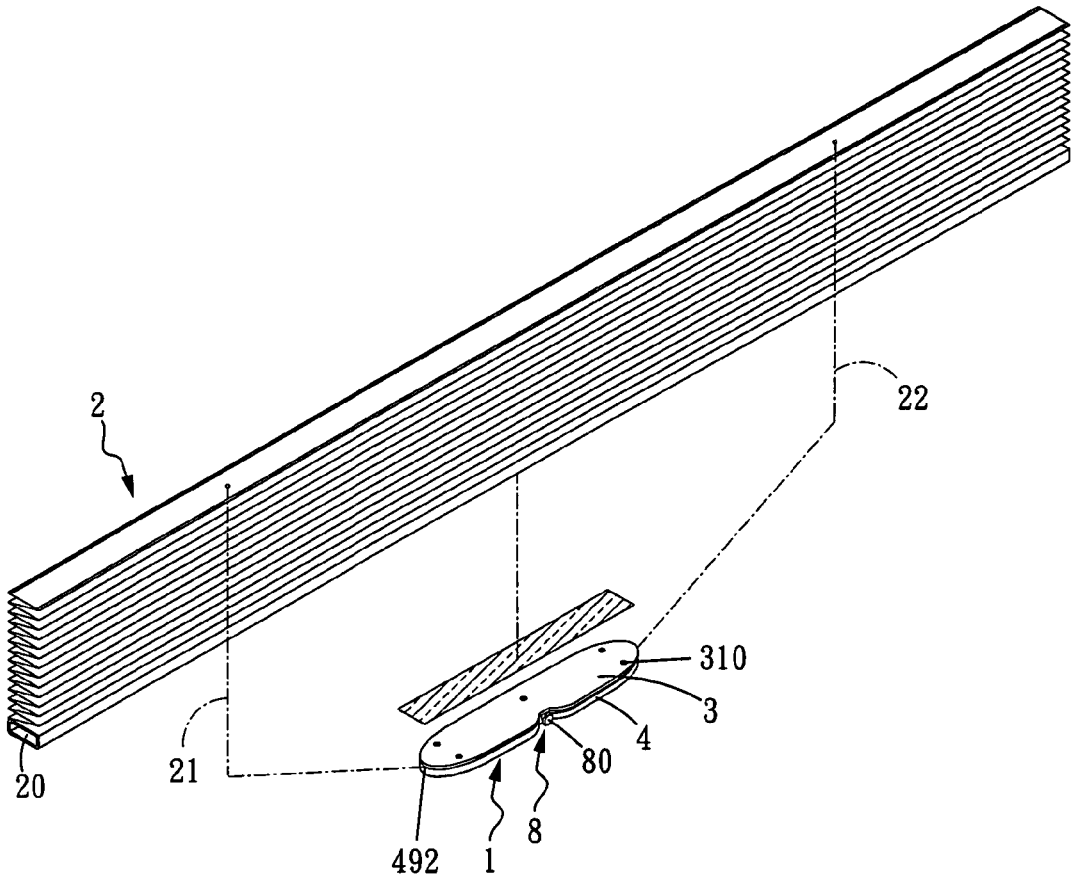
FIG. 5 is an exploded view of the present invention.
Figure 6:
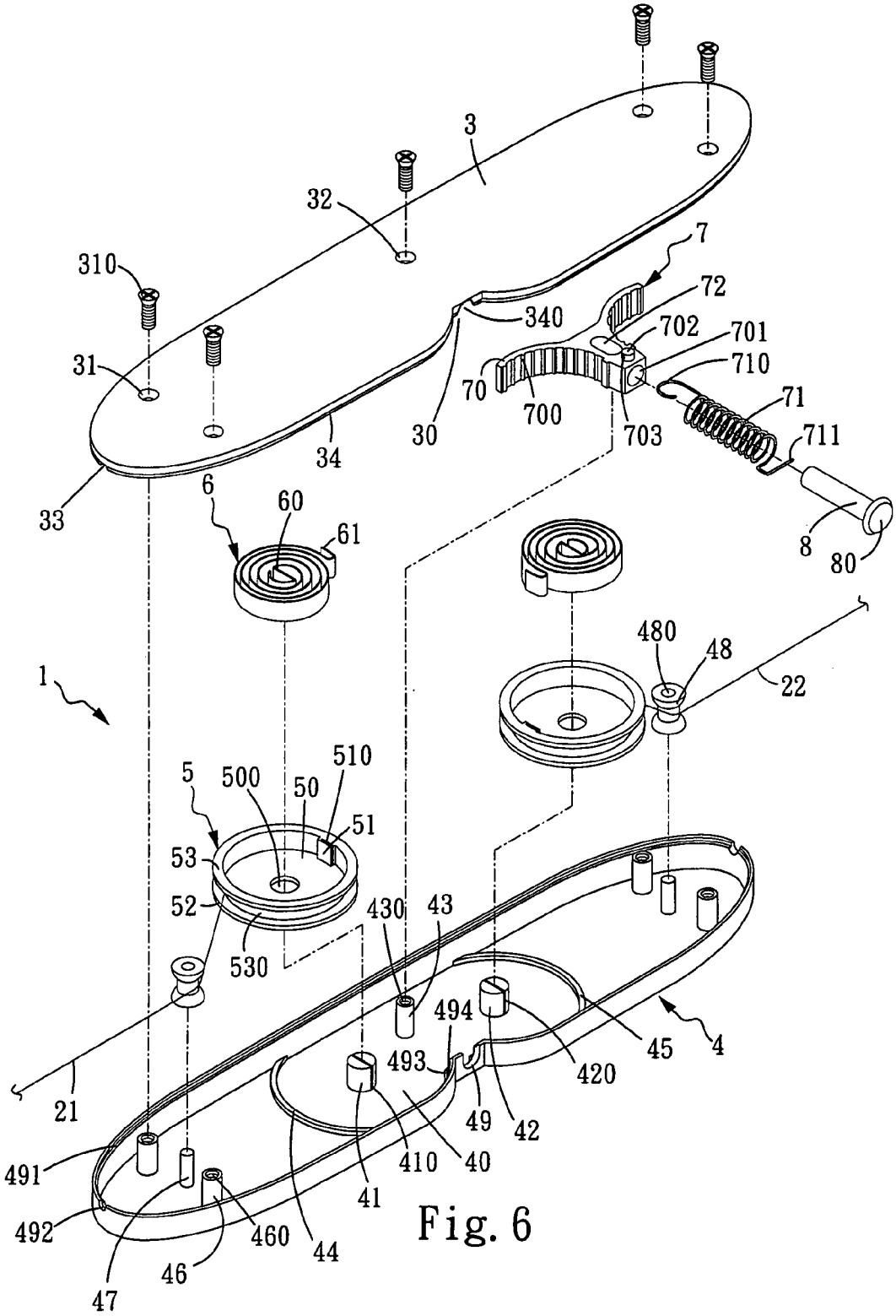
FIG. 6 is an exploded view of a pulling cord winder of the present invention.

The basic assembly of a pulling cord winder for a Venetian blind in accordance with the present invention is shown in FIGS. 5 and 6. The pulling cord winder 1 is installed directly at the bottom of a lower rail 20 of a Venetian blind 2, and a pulling cord 21, 22 is disposed separately on both sides of the pulling cord winder 1. The pulling cord winder 1 comprises: an upper base 3 and a lower base 4 engaged with each other, two fixed cams 41, 42; two spring coil wheels 5 mounted onto the fixed cams 41, 42 in a chamber 40 at the center of the lower base 4, and a spring 6 being disposed in each of the spring coil wheels 5 and hooked by both embedding ends 60,61 therein; a brake member 7 placed between the two spring coil wheels 5 and hooked by a drawspring 71; and a push rod 8 passing through the drawspring 71 and contacting the brake member 7, the push rod being pressed to release the brake member and released to apply the brake member, such that when the push rod 8 is released and presses the brake member 7, a resilience of the drawspring 71 pushes an arc pressing board 70 separately disposed on both sides of the brake member 7 to compress the spring coil wheel 5 into a compressed form, and thus braking the two spring coil wheels 5 and pressing the two springs 6 to lift or fix the Venetian blind and when the push rod is pressed to release the brake member, the spring coil wheels are placed in an open form to move said Venetian blinds.

The foregoing upper base 3 forms a long member with a recession 30 in the middle of the front end, and a burying hole 31, 32 is disposed on both distal ends and the middle of a lateral side of the upper base 3. An embedding member 34 is disposed separately on an attached surface at the front and rear ends of the upper base 3. An arc groove 340 is disposed in the middle of the embedding member 34 at the front end. The lower base 4 has a shape identical to that of the upper base 3 and a chamber 40 in the middle of the lower base 4 has a fixed cam 41, 42 corresponding to the latch groove 410, 420. A protruded rod 43 having a latch groove 430 is disposed on a lateral side in the middle of the two fixed cams 41, 42 and corresponding to the burying hole 32 disposed on a lateral side of the upper base 3. The two fixed cams 41, 42 comprise an arc blocking wall 44, 45 disposed at an external side, and the lower base 4 at its external side comprises a fastening rod 46 having a screw hole 460 and corresponding to the burying hole 31 of the upper base 3. The fastening rod 46 comprises a cam 47 being disposed at the central position of the fastening rod 46 and having an axle hole for connecting a guide wheel 48. The lower base 4 at the front and rear ends has an arc groove 49 and a recessed groove 491 corresponding to an arc groove 340 and an embedding member 34, and both ends have a perforation 492 for pulling or receiving a pulling cord 21, 22 from both sides of the Venetian blind. A latch member 493 having a perforation 494 is disposed on the internal side of a recessed surface of the arc groove 49. The two spring coil wheels 5 has a containing space 50 at the top, and a sheathing hole 500 is disposed in the middle of the bottom end of the containing space 50. The sheathing hole 500 is connected to the fixed cams 41, 42 of the lower base 4. A blocking member 51 having a latch groove 510 is protruded from an internal edge of the containing space 50. A winding region 530 for winding the pulling cords 21, 22 on both sides of the Venetian blind 2 is disposed between the protruded walls 52, 53 on both sides of the two spring coil wheels 5.

Both embedding ends 60, 61 of the two spring 6 are hooked respectively into the chamber 40 in the middle of the lower base 4 corresponding to the latch grooves 410, 420 of the fixed cams 41, 42 and into the latch groove 510 of the blocking member 51 of the two spring coil wheels 5. An arc pressing board 70 is extended separately from both sides of the brake member 7; a rough surface 700 is disposed on the internal side of the arc pressing board 70; and the embedding groove 701 and protruded rod 702 are disposed at a front end and a top of the brake member 7 respectively. A perforation 703 is disposed at the protruded rod 702 for inserting one end 710 of the drawspring 703. The other end 711 of the drawspring 71 is inserted into a perforation 494 of the latch member 493 of the lower base 4. A long hole 72 is disposed in the middle of the brake member 7 for passing through a protruded rod 43.

The push rod 8 at its end forms a pressing section 80, and the pressing section 80 is embedded in an embedding groove 701 at the front of the brake member 7.

The pulling cords 21, 22 on both sides of the Venetian blind 2 are wound around the winding region 530 of the two spring coil wheels during its assembly, such that the sheathing holes 500 of the two spring coil wheels 5 are coupled with the fixed cams 41, 42 corresponding to the chamber 40 of the lower base 4. Both embedding ends 60, 61 of the two springs 6 are latched respectively into the chamber 40 of the lower base 4 corresponding to the latch grooves 410, 420 and into the latch groove 510 of the blocking member 51 of the two spring coil wheels 5. The long hole 72 in the middle of the brake member 7 sheathes onto the protruded rod 43 of the lower base 4. The perforation 703 of the protruded rod 702 at the front end of the top of the brake member 7 is hooked to one end 710 of the drawspring 71, and one end of the drawspring 71 passes through the perforation 494 of the latch member 493 of the lower base 4. The push rod 8 is embedded into the embedding groove 701 at the front end of the brake member 7 and installed at the arc groove 49 at the front end of the lower base 4. Finally, the embedded member 34 disposed at the front and read end of the upper base 3 is embedded into the recessed groove 491 corresponding to the lower base 4, and secured into the burying holes 31, 32 on both sides of the lower base 3 and in the middle of the lateral side and all the way to the screw holes 460 on the lower base 4 corresponding to the fastening rod 46 by a screw 310 and the latch groove 430 of the protruded rod 43 respectively to define a thinner pulling cord winder 1. The pulling cord winder 1 is attached at the bottom of a lower rail 20 of the Venetian blind 2, such that the pulling cords 21, 22 on both sides of the Venetian blind 2 are wound or released through the perforations 492 on both sides of the lower base 4 into the winding region 530 of the two spring coil wheels 5. Thus, the thinner pulling cord winder 1 can reduce its weight as well as the force applied onto the internal drawspring 71 of the pulling cord winder 1. The overall pulling cord winder 1 is lighter and more convenient to be installed onto the bottom of the lower rail 20 at an end of the Venetian blind 2.

Figure 7:
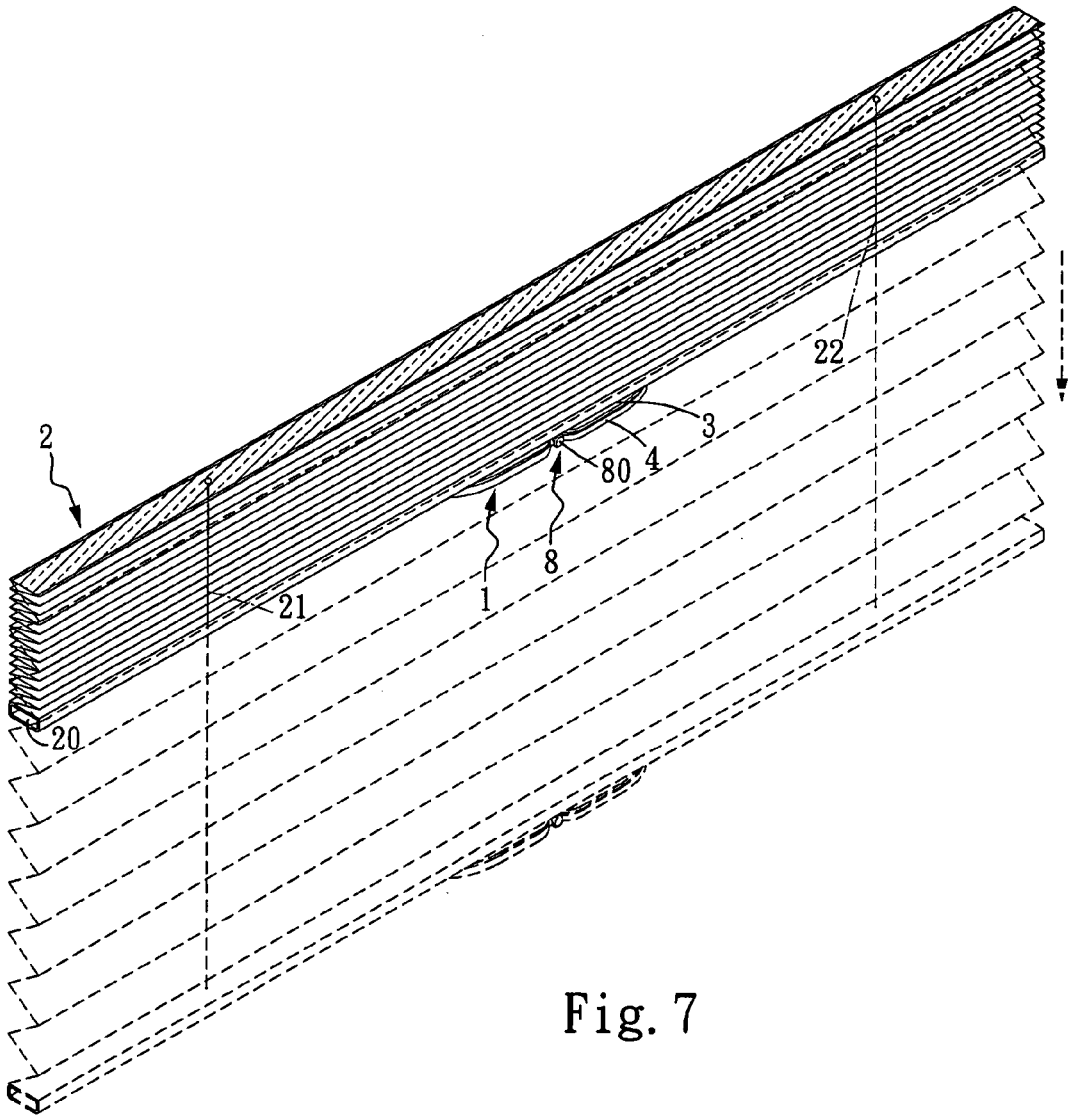
FIG. 7 is a schematic view of pulling a Venetian blinder of the present invention.
Figure 8A:
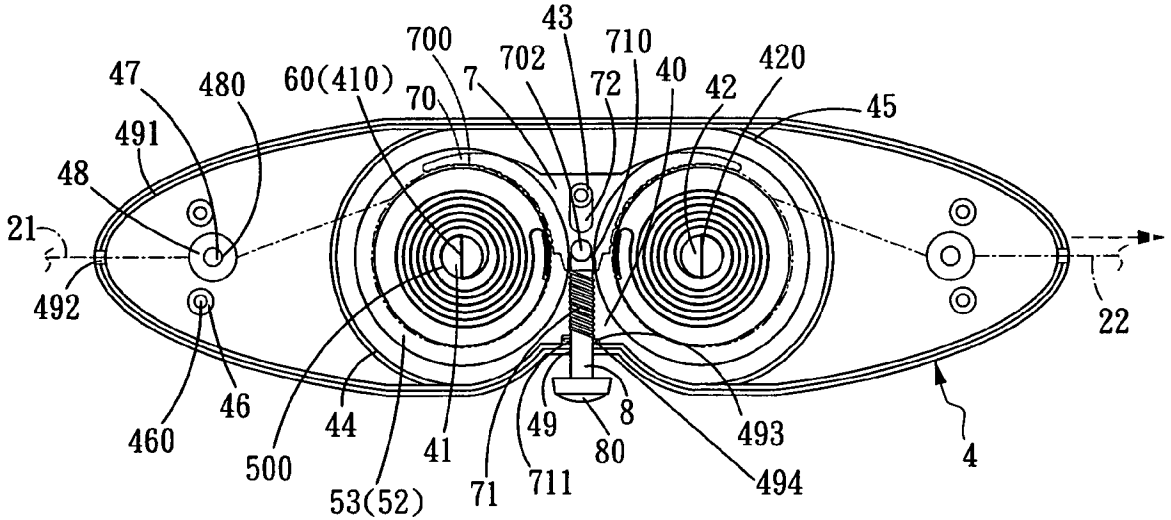
FIGS. 8A and 8B are top views of pulling the lift cords on both sides of a pulling cord winder of the present invention.
Figure 8B:
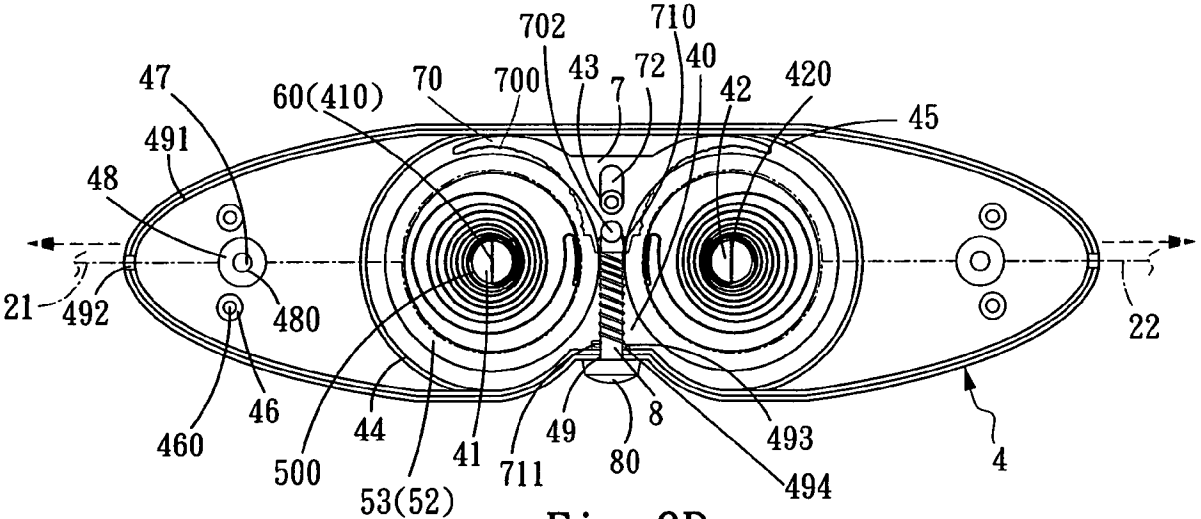

Referring to FIG. 7 together with FIGS. 8A and 8B, the pressing section 80 of the push rod 8 is pressed (or withdrawn) directly during its operation, and the arc pressing boards 70 on both sides of the brake member 7 also move backward. In meanwhile, the drawspring 71 installed at the external edge of the push rod 8 compresses the rough surfaces 700 on both sides of the arc pressing boards 70, and the originally compressed pulling cords 21, 22 in the winding region 53 or the two spring coil wheel 5 are in an open form (or compressed form), so that the two spring coil wheels 5 can rotate or brake and the two springs 6 can be compressed or released so as to lift or lower the Venetian blind. However, if it is necessary to pull or rewind the Venetian blind 2, the pressing section 80 of the push rod 8 is released, and a resilience of the drawspring 71 at the external edge of the push rod 8 acts as an individual brake of the brake member 7. Therefore, the brake member 7 will not be disabled when the pulling cords 21, 22 are pulled excessively or insufficiently and a gap is resulted, and thus the Venetian blind 2 can be pulled or wound to a desired height.

Figure 9:
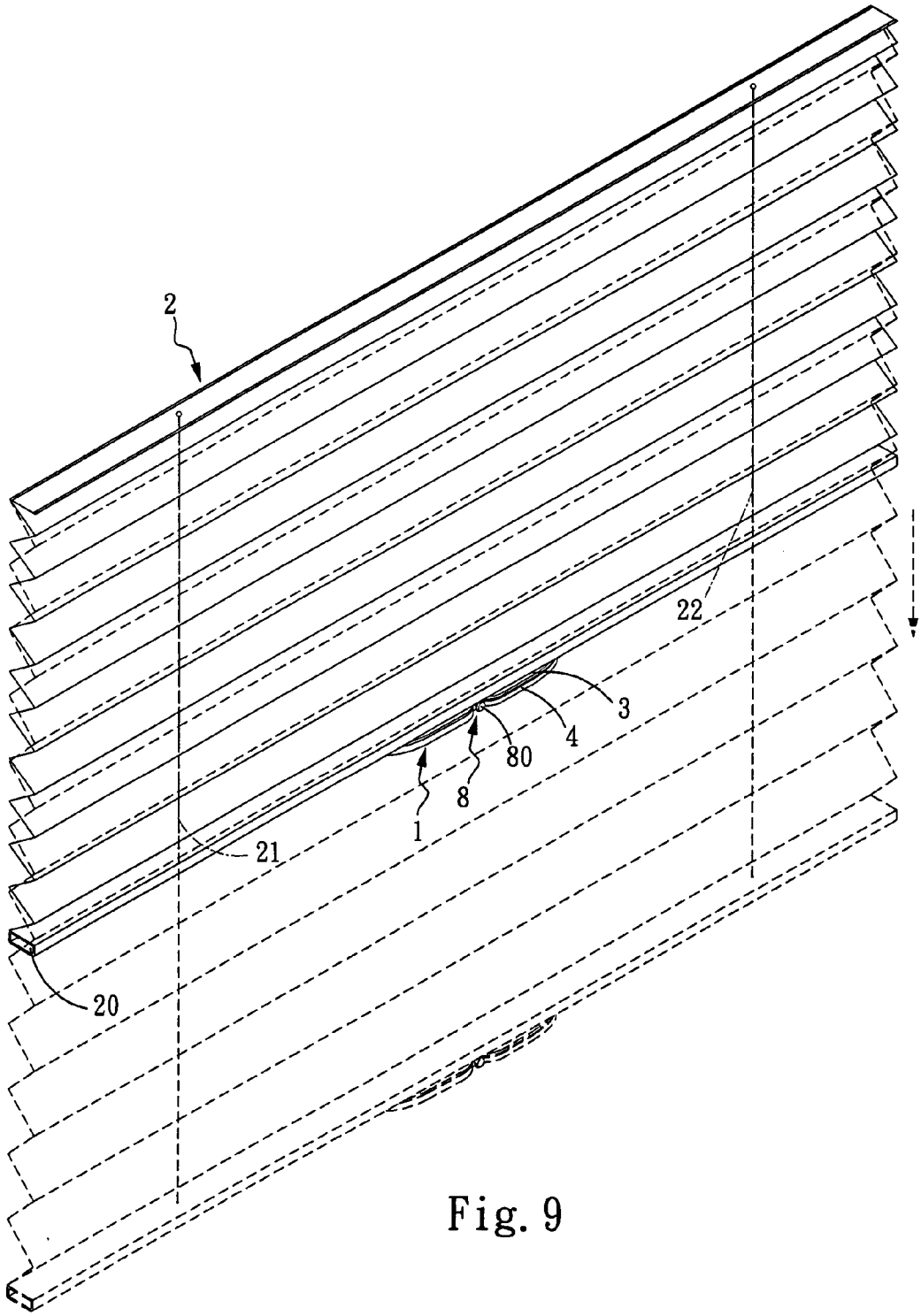
FIG. 9 is a schematic view of the Venetian blinder being lowered all the way to the bottom according to the present invention.
Figure 10:
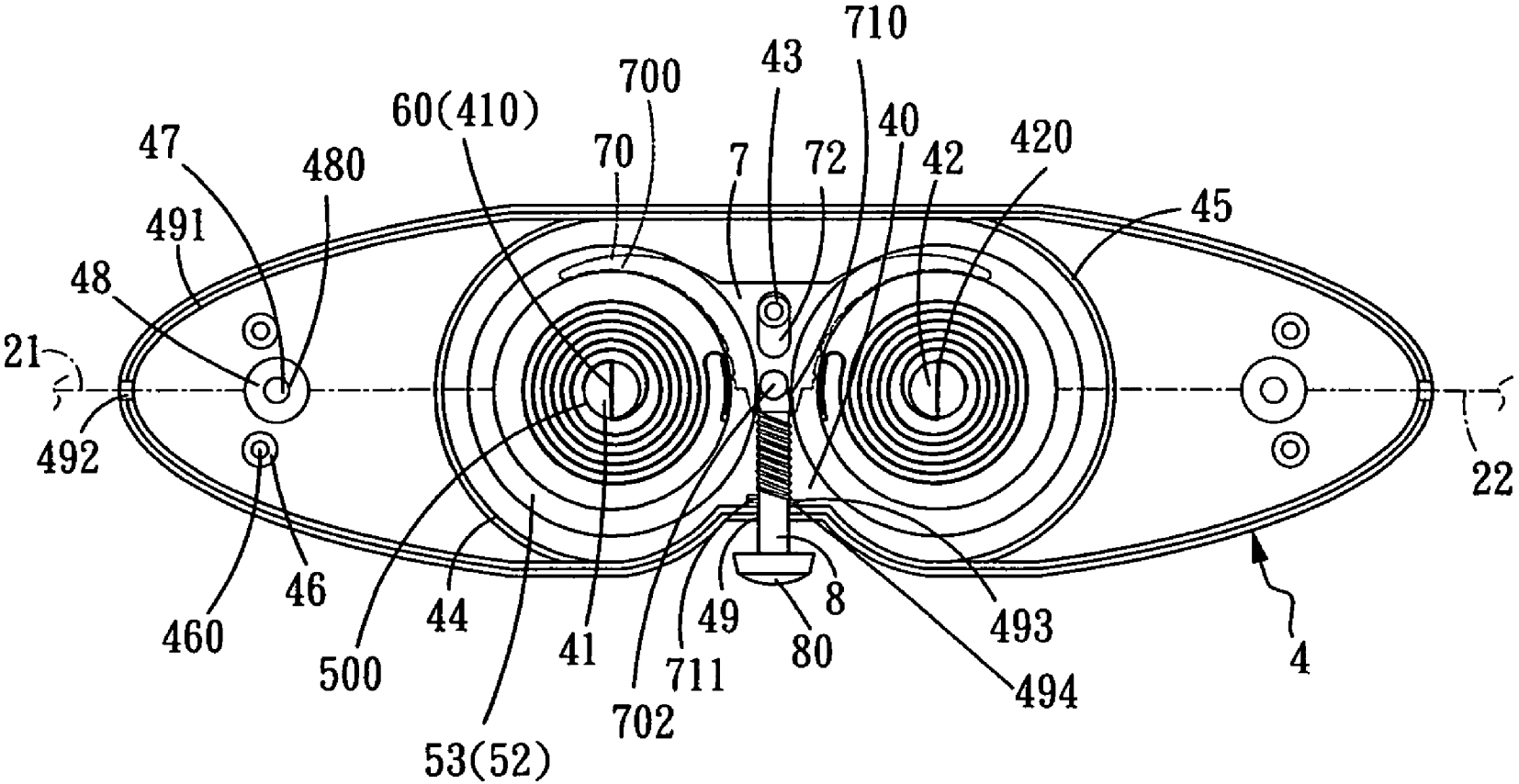
FIG. 10 is a top view of a spring coil wheel being pressed by rough surfaces of a brake member according to the present invention.

Referring to FIGS. 9 and 10, if the Venetian blind 2 is pulled to a fully opened state, the pulling cords 21, 22 in the winding region 530 of the two spring coil wheels 5 will be outwardly pulled all the way to the end, and the winding region 530 of the two spring coil wheel 5 is pressed and fixed by the increased friction of the rough surfaces 700 of the arc pressing boards 70 on both sides of the brake member 7, so that the two spring coil wheels 5 will not fall off.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pulling cord winder and a Venetian blind, the pulling cord winder being installed at the bottom of a lower rail of the Venetian blind and storing pulling cords separately disposed on opposing sides of said Venetian blind, comprising:

an upper and a lower corresponding base, being engaged with each other;

two spring coil wheels each having one of said cords windable thereon and each mounted onto a fixed cam and in a chamber at the center of said lower base;

a spring, being disposed in each of said spring coil wheels and one end section of each spring being hooked to a respective spring coil wheel;

a brake member, being held between said two spring coil wheels and hooked by a drawspring; and a push rod, passing through said drawspring and contacting said brake member said pushrod may be pressed to release said brake member and released to apply said brake member; so that when said push rod is released, the resilience of said drawspring pulls an arc-shaped pressing boards disposed respectively on opposing sides of said brake member, each pressing board compressing against a respective spring coil wheels so as to frictionally brake said two spring coil wheels and control said two springs to fix said Venetian blind in position; and said pushrod may be pressed to release said brake member from frictional contact with said spring coiling wheel so that said spring coil wheels are positioned to rotate to allow movement of said Venetian blind, wherein said lower base has an identical shape with said upper base, and said lower base includes said fixed cams disposed in said chamber in the middle of said lower base with each cam including a latch groove that receives an opposing end section of respective ones of said springs, a protruded rod having a second latch groove disposed on a lateral side in the middle of said two fixed cams, two arc blocking walls disposed on respective external sides of said two fixed cams, a pair of fastening rods having a screw hole and disposed on each end of said lower base, such that second cams are installed respectively in a middle position between a pair of said fastening rods on each end of said lower base, an arc groove and a recessed groove respectively disposed at the front and rear ends of said lower base and a perforation separately disposed on both end of said lower base, and a latch member having a perforation for holding an end of said drawspring and being disposed on an internal side of a sunken surface of said arc groove.

2. The pulling cord winder for a Venetian blind of claim 1, wherein said upper base at the center of the front end forms a long member with a recession, and a burying hole is disposed separately on both distal ends and the middle of a lateral side of said upper base, and an embedding member is disposed separately on an attached surface at the front and rear ends of said upper base.

3. The pulling cord winder for a Venetian blind of claim 2, wherein said embedding member in the middle of the front end has an arc groove.

4. The pulling cord winder for a Venetian blind of claim 1, wherein each of said spring coil wheels has a containing space at its top, and a sheathing hole is disposed at the center of the bottom of said containing space, and said sheathing hole is coupled with said fixed cam of said lower base, and a blocking member having a latch groove protrudes from an internal edge of said containing space, and said two spring coil wheels have a cord winding area disposed in the middle of a protruded wall on both sides of said two spring coil wheels for winding said pulling cord on both sides of said Venetian blind.

5. The pulling cord winder for a Venetian blind of claim 1, wherein said spring forms an inverse corresponding hook shape at both end sections.

6. The pulling cord winder for a Venetian blind of claim 1, wherein said arc-shaped pressing board extends outwardly from both sides of said brake member, an embedding groove disposed at the front end of said brake member, a second protruded rod disposed on said embedding groove, and a long hole disposed in the middle of said embedding groove.

7. The pulling cord winder for a Venetian blind of claim 6, wherein said arc-shaped pressing board has a rough surface on its internal side.

8. The pulling cord winder for a Venetian blind of claim 6, wherein said second protruded rod has a perforation.

9. The pulling cord winder for a Venetian blind of claim 8, wherein said push rod has a pressing section at an end and said drawspring has one end thereof engaged with a perforation on said lower base.

10. The pulling cord winder for a Venetian blind of claim 9, wherein said drawspring has an inverse hook shape and is disposed separately on both ends, one end being inserted into said perforation of said second protruded rod and the other end being inserted into said perforation of said latch member of said lower base.

11. A pulling cord winder and a Venetian blind, the pulling cord winder being installed at the bottom of a lower rail of the Venetian blind and storing pulling cords separately disposed on opposing sides of said Venetian blind, comprising:

an upper and a lower corresponding base, being engaged with each other;

two spring coil wheels each having one of said cords windable thereon and each mounted onto a fixed cam and in a chamber at the center of said lower base;

a spring, being disposed in each of said spring coil wheels and one end section of each spring being hooked to a respective spring coil wheel;

a brake member, being held between said two spring coil wheels and hooked by a drawspring; and a push rod, passing through said drawspring and contacting said brake member, said pushrod may be pressed to release said brake member and released to apply said brake member,; so that when said push rod is released, the resilience of said drawspring pulls an arc-shaped pressing boards disposed respectively on opposing sides of said brake member, each pressing board compressing against a respective spring coil wheels so as to frictionally brake said two spring coil wheels and control said two springs to fix said Venetian blind in position; and said pushrod may be pressed to release said brake member from frictional contact with said spring coiling wheel so that said spring coil wheels are positioned to rotate to allow movement of said Venetian blind, wherein said arc-shaped pressing boards extend outwardly from opposing sides of said brake member, an embedding groove disposed at the front end of said brake member, a first protruded rod disposed on a top of the brake member and having one end of said drawspring attached thereto, and a long hole disposed in the middle of said brake member for slidably engaging a second protruded rod.

12. The pulling cord winder for a Venetian blind of claim 11, wherein said arc-shaped pressing board has a rough surface on its internal side.

13. The pulling cord winder for a Venetian blind of claim 11, wherein said first protruded rod has a perforation.

14. A pulling cord winder and a Venetian blind, the pulling cord winder being installed at the bottom of lower rail of the Venetian blind and storing pulling cords separately disposed on opposing sides of said Venetian blind, comprising:

an upper and a lower corresponding base, being engaged with each other;

two spring coil wheels each having one of said cords windable thereon and each mounted onto a fixed cam and in a chamber at the center of said lower base;

a spring, being disposed in each of said spring coil wheels and one end section of each spring being hooked to a respective spring coil wheel;

a brake member, being held between said two spring coil wheels and hooked by a drawspring; and a push rod, passing through said drawspring and contacting said brake member; said push rod may be pressed to release said brake member and released to apply said brake member; so that when said push rod is released, the resilience of said drawspring pulls an arc-shaped pressing boards disposed respectively on opposing sides of said brake member, each pressing board compressing against a respective spring coil wheels so as to frictionally brake said two spring coil wheels and control said two springs to fix said Venetian blind in position; and said pushrod may be pressed to release said brake member from frictional contact with said spring coiling wheel so that said spring coil wheels are positioned to rotate to allow movement of said Venetian blind, wherein said push rod has a pressing section at an end and said drawspring has one end thereof engaged with a perforation on said lower base. passes through its external edge.

* * * * *